US008851034B2

(12) United States Patent
Boese et al.

(10) Patent No.: US 8,851,034 B2
(45) Date of Patent: Oct. 7, 2014

(54) HYDRAULIC CAMSHAFT PHASER

(71) Applicant: Schaeffler Technologies AG & Co. KG, Herzogenaurach (DE)

(72) Inventors: Olaf Boese, Nuremberg (DE); Christoph Betz, Hausen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/951,045

(22) Filed: Jul. 25, 2013

(65) Prior Publication Data

US 2014/0026835 A1 Jan. 30, 2014

(30) Foreign Application Priority Data

Jul. 26, 2012 (DE) ..... 10 2012 213 176

(51) Int. Cl.
*F01L 1/34* (2006.01)
*F01L 1/344* (2006.01)

(52) U.S. Cl.
CPC ..... *F01L 1/344* (2013.01); *F01L 2001/34479* (2013.01); *F01L 2103/00* (2013.01); *F01L 1/3442* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS 8,635,978 B2 * 1/2014 Braun ..... 123/90.17

FOREIGN PATENT DOCUMENTS

DE 10 2009 014 338 9/2010

* cited by examiner

*Primary Examiner* — Ching Chang
(74) *Attorney, Agent, or Firm* — Davidson, Davidson & Kappel, LLC

(57) ABSTRACT

A hydraulic camshaft phaser includes an outer rotor and an inner rotor rotationally adjustable and arranged concentrically about a common axis of rotation. At least one hydraulic chamber is formed between the outer rotor and the inner rotor, into which hydraulic chamber at least one connected vane extends from each of the outer rotor and the inner rotor, thereby dividing the hydraulic chamber into at least one pressure chamber pair formed by two pressure chambers. The inner rotor has a circular opening extending concentrically along the axis of rotation, a sealing portion being formed on the inner surface of the circular opening between two axial faces of the inner rotor, and the opening having a larger inner diameter on both sides of the sealing portion than in the sealing portion. The inner rotor is a sintered part, and the sealing portion of the inner rotor is calibrated.

8 Claims, 2 Drawing Sheets

HYDRAULIC CAMSHAFT PHASER

This claims the benefit of German Patent Application DE 10 2012 213 176.0, filed Jul. 26, 2012 and hereby incorporated by reference herein.

The present invention relates to a hydraulic camshaft phaser for an internal combustion engine, including an outer rotor and an inner rotor, the outer rotor and the inner rotor being rotationally adjustable and arranged concentrically about a common axis of rotation. At least one hydraulic chamber is formed between the outer rotor and the inner rotor, into which hydraulic chamber at least one connected vane extends from each of the outer rotor and the inner rotor, thereby dividing the hydraulic chamber into at least one pressure chamber pair formed by two pressure chambers. The inner rotor has a circular opening extending concentrically along the axis of rotation, a sealing portion being formed on the inner surface of the circular opening between two axial faces of the inner rotor, and the opening having a larger cross-sectional area on both sides of the sealing portion than in the sealing portion.

BACKGROUND

In internal combustion engines with mechanical valve actuation, gas exchange valves are actuated by the cams of a camshaft which is driven by a crankshaft, the valve timing being definable by the arrangement and the shape of the cams. The valve timing can be selectively controlled by varying the phase relationship between the crankshaft and the camshaft as a function of the instantaneous operating state of the internal combustion engine, which makes it possible to achieve advantageous effects, such as a reduction in fuel consumption and pollutant generation.

Devices for adjusting the phase relationship between the crankshaft and the camshaft are commonly known as camshaft phasers.

In general, camshaft phasers include a drive part which is drivingly connected to the crankshaft via a drive sprocket, and an output part which is fixed to the camshaft, as well as an adjusting mechanism which is connected between the drive part and the output part and transmits the torque from the drive part to the output part and which makes it possible to adjust and fix the phase relationship between the two.

In a conventional design as a hydraulic rotary actuator, the drive part is configured as an outer rotor and the output part is configured as an inner rotor, the outer rotor and inner rotor being rotationally adjustable and arranged concentrically about a common axis of rotation. In the radial space between the outer rotor and the inner rotor, at least one hydraulic chamber is formed by one of the two rotors, and a vane connected to the respective other rotor extends into the hydraulic chamber, thereby dividing it into a pair of oppositely acting pressure chambers. By selectively pressurizing the pressure chambers, the outer rotor and the inner rotor can be adjusted relative to each other, thereby varying the phase relationship between the crankshaft and the camshaft.

For purposes of pressurizing the oppositely acting pressure chambers, the inner rotor is typically provided with holes to which a pressurized hydraulic medium can be supplied through a central opening in the inner rotor. The two hydraulic circuits must be hydraulically separated from each other by suitable sealing measures. A hydraulic camshaft phaser of this type is known, for example, from DE 10 2009 014 338, in particular FIG. 4A and FIG. 4B thereof.

SUMMARY OF THE INVENTION

It is an object of the present invention to provide a camshaft phaser that is cost-effective to manufacture.

The present invention provides a hydraulic camshaft phaser for an internal combustion engine which includes an outer rotor and an inner rotor, the outer rotor and the inner rotor being rotationally adjustable and arranged concentrically about a common axis of rotation. At least one hydraulic chamber is formed between the outer rotor and the inner rotor, into which hydraulic chamber at least one connected vane extends from each of the outer rotor and the inner rotor, thereby dividing the hydraulic chamber into at least one pressure chamber pair formed by two pressure chambers. The inner rotor has a circular opening extending concentrically along the axis of rotation, a sealing portion being formed on the inner surface of the circular opening between two axial faces of the inner rotor, and the opening having a larger cross-sectional area on both sides of the sealing portion than in the sealing portion. In accordance with the present invention, the inner rotor is a sintered part, and the sealing portion of the inner rotor is calibrated.

The inner rotor of the camshaft phaser is shaped such that the inner rotor can be manufactured ready out-of-the-mold by the sintering process, which has a favorable effect on manufacturing cost. Thus, the inner rotor can be used in the camshaft phaser without having to be machined, at least in the region of the circular opening, which makes it possible to reduce the manufacturing effort and corresponding costs. This also allows the inner rotor to be manufactured with high process reliability, which reduces rejects and may thereby also reduce the manufacturing cost.

In this context, the term "calibrated" refers to a step in the manufacture of sintered components that may typically be performed subsequent to the sintering of the component, before the component is fully completed. Unlike other surfaces of the inner rotor, the radially inner surface of the sealing portion is subject to higher requirements in terms of dimensional accuracy and surface finish. Moreover, in the region of the sealing portion, higher demands are placed on the material strength near the surface. The calibration of the sealing portion of the inner rotor is performed using a special tool which represses the inner rotor in the region of the sealing portion, thereby making it possible to achieve improved surface finish, strength and dimensional accuracy for the sealing portion.

In an advantageous embodiment, a core assembly is disposed in the sealing portion of the circular opening. The core assembly is preferably rotatable with respect to the inner rotor and provides a substantially pressure-tight connection, whereby the two regions located outside the sealing portion on both sides thereof may form part of separate hydraulic circuits, and thus may be subjected to different pressures. In addition, the core assembly may be used to center and align the inner rotor.

The core assembly is preferably a central valve. By mounting a central valve in the circular opening of the inner rotor, a simple and especially compact design can be achieved for the camshaft phaser. This also results in short hydraulic paths from the central valve, which controls the camshaft phaser, to the pressure chambers, so that the camshaft phaser can be adjusted and controlled rapidly and accurately.

In an advantageous embodiment, a clearance fit is provided between the core assembly and the sealing portion. This allows for easy rotation of the core assembly, in particular a central valve, relative to the inner rotor, while at the same time allowing hydraulic separation of the two hydraulic circuits for the pressure chamber pairs. Thus, there is no need for additional means, such as a ball bearing, for rotatably supporting the core assembly in the inner rotor. The surface finish and dimensional accuracy required for a suitable clearance fit can be obtained in a cost-effective manner and without machining of the sealing portion by manufacturing the inner rotor using a sintering process, in particular by calibrating the sealing portion.

Preferably, the inner rotor and the vanes connected to the inner rotor form an integral component. This allows for a lighter-weight and inexpensive camshaft phaser. Integration of the vanes may be advantageous, in particular in the case of a sintered part.

In an advantageous embodiment, the sealing portion has a constant inside diameter. This enables an efficient and non-wearing seal to be made between a core component [core assembly] and the sealing portion, in particular during possible rotational movements between the inner rotor and the core assembly.

Preferably, the sealing portion is disposed symmetrically between the axial faces of the inner rotor. This allows uniform routing of forces in the inner rotor, which may have a positive effect on the life and resistance to wear of the inner rotor. Moreover, the sintering process and the preceding pressing operation can thereby be simplified.

Advantageously, the circular opening has equal diameters on both sides of the sealing portion. Equal diameters on both sides of the sealing portion can make it possible to obtain comparable pressure conditions in these regions, thereby enabling the pressure chambers of a pressure chamber pair to be hydraulically controlled in a comparable manner. This may also contribute to axial mountability, regardless of direction.

Further advantages and advantageous embodiments of the invention will be apparent from the following description, the figures, and the claims.

BRIEF DESCRIPTION OF THE DRAWINGS

Other features of the invention may be derived from the following description of drawings, which illustrate preferred embodiments of the invention.

In the drawings.

DETAILED DESCRIPTION

Figure 1A:
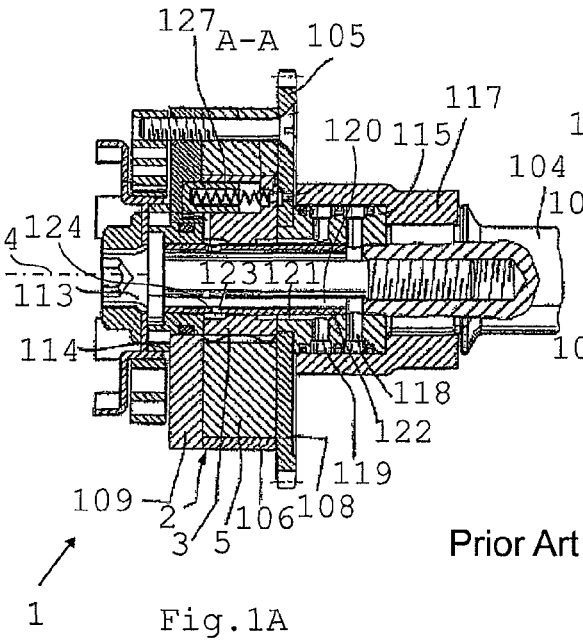
Prior Art Fig.1A
FIGS. 1A and 1B are axial and radial sectional views illustrating a conventional rotary actuator.
Figure 1B:
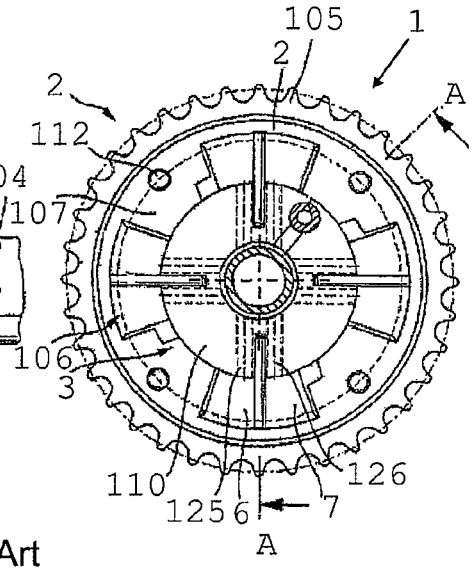

FIG. 1A shows an axial section along line A-A of a hydraulic camshaft phaser 1, which is shown in FIG. 1B in radial section. Accordingly, camshaft phaser 1 is attached to an end face of a camshaft 104 and includes an outer rotor 2 drivingly connected to a crankshaft and an inner rotor 3 non-rotatably connected to camshaft 104, the outer rotor and the inner rotor being rotationally adjustable relative to each other and arranged concentrically about a common axis of rotation 4. Outer rotor 2 is drivingly connected to the crankshaft via a drive sprocket 105 and has an outer ring 106, on whose inner circumference are arranged radial partition walls 107 which, together with first and second end plates 108, 109 and a rotor hub 110 of inner rotor 3, bound circumferentially distributed hydraulic chambers. The two end plates 108,109 and outer ring 106 are clamped together by axial screws 112. Rotor hub 110 of inner rotor 3, a bushing 114 and a rotary oil passage member 115 are jointly clamped to camshaft 104 by a clamping bolt 113 threaded into a threaded hole of camshaft 104. Mounted on rotor hub 110 are a plurality of vanes 5 which divide each hydraulic chamber into a pair of oppositely acting pressure chambers 6,7. A pressure medium, usually pressure oil, is supplied from the lubrication oil circuit of the internal combustion engine to pressure chambers 6,7 via a control valve, the pressure medium passing through a camshaft bearing 117, rotary oil passage member 115 and first radial channels 118 and second radial channels 119 thereof, into an inner annular channel 120 and an outer annular channel 121. The two annular channels 120,121 are formed by an oil separation sleeve 122 inserted in a cavity of rotary oil passage member 115, first outer annular channel 121 being formed between oil separation sleeve 122 and rotary oil passage member 115. The pressure medium passes from inner annular channel 120 through first radial bores 123 into a second outer annular channel 124, and from there through second radial bores 125 into pressure chambers 6. From first outer annular channel 121, the pressure medium passes through third radial bores 126 into pressure chambers 7. Camshaft phaser 1 further has an axial locking pin 127.

Figure 2A:
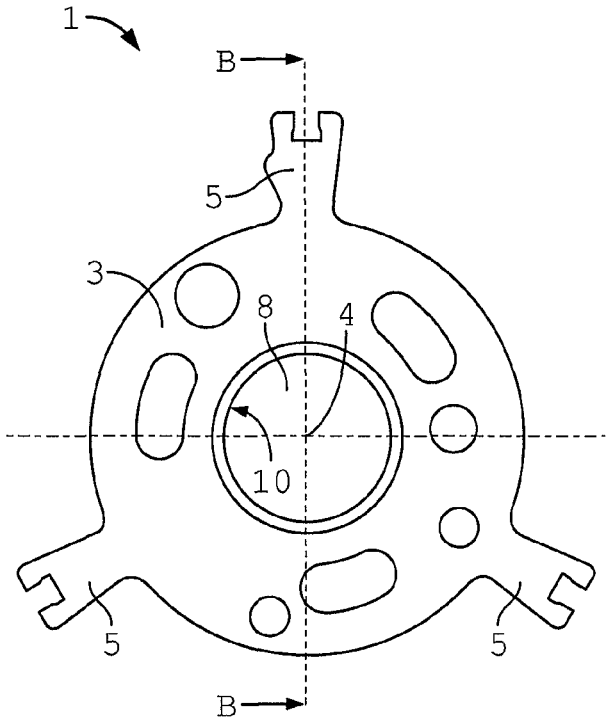
FIGS. 2A and 2B are isolated views of a camshaft phaser according to the present invention.
Figure 2B:
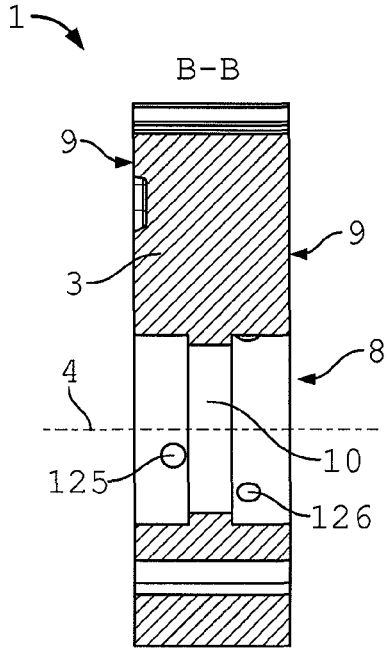

FIG. 2 shows an exemplary embodiment of an inner rotor 3 of a camshaft phaser 1 according to the present invention. FIG. 2A shows inner rotor 3 in face view, and FIG. 2B shows inner rotor 3 in cross-sectional view. In this exemplary embodiment, sintered inner rotor 3 has three vanes 5 which, in this embodiment, are advantageously formed integrally therewith, so that three pressure chamber pairs can be formed in hydraulic camshaft phaser 1, each pair including a first pressure chamber 6 and a second pressure chamber 7. It can be seen that circular opening 8, which extends between the two axial faces 9 of inner rotor 3, is concentric with the axis of rotation 4. FIG. 2B shows circular opening 8 of inner rotor 3 in a cross-sectional view. Sealing portion 10 is disposed centrally between axial faces 9 and has a reduced diameter compared to the other portions of circular opening 8. Thus, sealing portion 10 constitutes the smallest inner diameter of circular opening 8. Along axis of rotation 4, the inner diameter is enlarged outside of sealing portion 10 on both sides thereof, so that circular opening 8 may advantageously be manufactured to have three different portions, such as in this exemplary embodiment, using a sintering process without undercuts.

In a typical exemplary embodiment (see also FIG. 3), only sealing portion 10 of the inner surface of circular opening 8 may be in contact with a core assembly 11 and, therefore, higher demands are placed on the surface and tolerances of sealing portion 10 of sintered inner rotor 3. Therefore, sealing portion 10 is calibrated, thereby allowing it to be improved in terms of its surface, dimensional accuracy and strength subsequent to its production in the sintering process. The calibration may be performed using a tool in the region of sealing portion 10.

Figure 3:
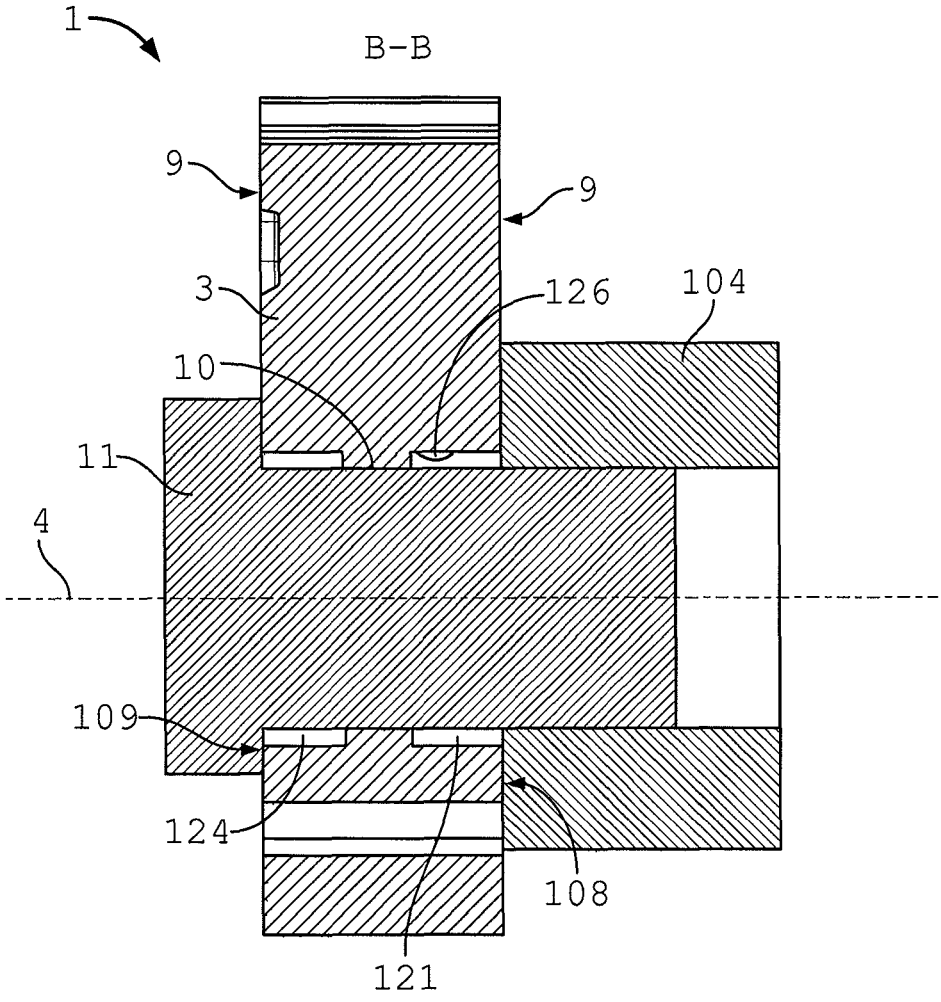
FIG. 3 is a view showing a detail of a camshaft phaser.

FIG. 3 shows a cross-sectional detail of inner rotor 3 in a mounted state, with a core assembly 11, in this exemplary embodiment a central valve, disposed in circular opening 8. Two outer annular channels 121,124 are formed on both sides of sealing portion 10, allowing the pressure medium to pass therethrough and through radial bores 125,126 to pressure chambers 6,7. Sealing portion 10 separates the two pressurized hydraulic circuits for pressure chambers 6,7, in conjunction with core assembly 11 or the central valve. During adjustment of camshaft phaser 1, the central valve directs the pressure into outer annular channels 121,124, respectively. Outer annular channels 121,124 are axially bounded by first and second end plates 108,109, which abut axial faces 9 of inner rotor 3. In this exemplary embodiment, end plates 108, 109 are provided by core assembly 11 and camshaft 104. In contrast to the known camshaft phaser 1 of FIG. 1, in this exemplary embodiment, the two outer annular channels 121,

124 are bounded laterally in respective planes of axial faces 9, so that the inflow of pressure medium occurs axially in the two outer annular channels. In particular, outer annular channels 121,124 are not provided by grooves formed in inner rotor 3 with two radial outer side walls. Thus, annular channels 121,124 can be easily produced on inner rotor 3 using a sintering process without undercuts.

LIST OF REFERENCE NUMERALS

1 camshaft phaser
2 outer rotor
3 inner rotor
4 axis of rotation
5 vane
6 pressure chamber
7 pressure chamber
8 circular opening
9 axial face
10 sealing portion
11 core assembly
104 camshaft
105 drive sprocket
106 outer ring
107 radial partition walls
108 end plate
109 end plate
110 rotor hub
112 axial screw
113 clamping bolt
114 bushing
115 rotary oil passage member
117 camshaft bearing
118 radial channels
119 radial channels
120 inner annular channel
121 outer annular channel
122 oil separation sleeve
123 radial bore
124 outer annular channel
125 radial bore
126 radial bore
127 locking pin

What is claimed is:

1. A hydraulic camshaft phaser for an internal combustion engine, comprising:

an outer rotor; and an inner rotor, the outer rotor and the inner rotor being rotationally adjustable and arranged concentrically about a common axis of rotation;

at least one hydraulic chamber being formed between the outer rotor and the inner rotor, into which hydraulic chamber at least one connected vane extends from each of the outer rotor and the inner rotor, thereby dividing the hydraulic chamber into at least one pressure chamber pair formed by two pressure chambers;

the inner rotor having a circular opening extending concentrically along the axis of rotation, a sealing portion being formed on an inner surface of the circular opening between two axial faces of the inner rotor, the circular opening having a larger cross-sectional area on both sides of the sealing portion than in the sealing portion, the inner rotor being a sintered part, the sealing portion of the inner rotor being calibrated.

2. The hydraulic camshaft phaser as recited in claim 1 wherein a core assembly is disposed in the sealing portion of the opening.

3. The hydraulic camshaft phaser as recited in claim 2 wherein the core assembly includes a central valve.

4. The hydraulic camshaft phaser as recited in claim 2 wherein a clearance fit is provided between the core assembly and the sealing portion.

5. The hydraulic camshaft phaser as recited in claim 1 wherein the inner rotor and the at least one vane connected to the inner rotor form an integral component.

6. The hydraulic camshaft phaser as recited in claim 1 wherein the sealing portion has a constant inside diameter.

7. The hydraulic camshaft phaser as recited in claim 1 wherein the sealing portion is disposed symmetrically between the axial faces of the inner rotor.

8. The hydraulic camshaft phaser as recited in claim 1 wherein the circular opening has equal diameters on both sides of the sealing portion.

* * * * *